US009296449B2

(12) United States Patent
Howard et al.

(10) Patent No.: US 9,296,449 B2
(45) Date of Patent: Mar. 29, 2016

(54) DRILLING SHIP FOR POLAR REGION

(75) Inventors: Norman D. Howard, Houston, TX (US); Gi Yun Lee, Gyeongsangnam-do (KR); Hun Gi Lee, Gyeonggi-Do (KR)

(73) Assignees: TRANSOCEAN SEDCO FOREX VENTURES LIMITED, George Town, Grand (KY); DAEWOO SHIPBUILDING & MARINE ENGINEERING CO., LTD., Seoul (KR)

( * ) Notice: Subject to any disclaimer, the term of this patent is extended or adjusted under 35 U.S.C. 154(b) by 0 days.

(21) Appl. No.: 13/883,553

(22) PCT Filed: Jun. 28, 2011

(86) PCT No.: PCT/KR2011/004690
§ 371 (c)(1),
(2), (4) Date: Dec. 19, 2013

(87) PCT Pub. No.: WO2012/060530
PCT Pub. Date: May 10, 2012

(65) Prior Publication Data

US 2014/0116317 A1 May 1, 2014

(30) Foreign Application Priority Data

Nov. 5, 2010 (KR) ..... 10-2010-0109530

(51) Int. Cl.
*B63B 35/44* (2006.01)

(52) U.S. Cl.
CPC ..... *B63B 35/4413* (2013.01)

(58) Field of Classification Search
CPC ..... B63B 35/4413
USPC ..... 114/264, 265; 166/352
See application file for complete search history.

(56) References Cited

U.S. PATENT DOCUMENTS 2,804,951 A * 9/1957 Kolt ..... E21B 15/00 135/115
3,023,808 A 3/1962 St. John
(Continued)

FOREIGN PATENT DOCUMENTS

JP 59-223593 A 12/1984
JP 60-126589 U 8/1985
(Continued)

OTHER PUBLICATIONS

Office Action dated Feb. 18, 2014 of corresponding Japanese Patent Application 2013-536485—3 pages.
(Continued)

*Primary Examiner* — Edwin Swinehart
(74) *Attorney, Agent, or Firm* — Knobbe Martens Olson & Bear LLP

(57) ABSTRACT

Provided is an arctic drill ship an arctic drill ship which includes a weather tight structure protecting a drill floor from air, and a side strake supporting the weather tight structure around a drilling work area. It is possible to economically and easily manufacture the weather tight structure which minimizes the influence of outside air on the drilling operation in the polar regions, and it is possible to efficiently support the hull longitudinal strength and the weather tight structure with the use of the side strake structure solely. Therefore, a structure which may cause a disturbance in the drilling work area is minimized, and it is unnecessary to install a separate structural reinforcement member for a drilling workspace in the polar regions. In addition, the drilling workspace in the polar regions can be effectively ensured, and a spatial limitation in an upper portion of a moonpool can be solved.

14 Claims, 2 Drawing Sheets

(56) References Cited

U.S. PATENT DOCUMENTS

| | | | | | |
|---|---|---|---|---|---|
| 3,618,679 | A | * | 11/1971 | Crooke | 175/135 |
| 3,749,162 | A | | 7/1973 | Anders | |
| 4,613,001 | A | | 9/1986 | Edberg et al. | |
| 6,068,069 | A | | 5/2000 | Scott et al. | |

FOREIGN PATENT DOCUMENTS

| | | | | | |
|---|---|---|---|---|---|
| JP | 03-005197 | Y2 | | 2/1991 | |
| JP | 05-005717 | B2 | | 1/1993 | |
| JP | 3868902 | B2 | | 1/2007 | |
| WO | WO 9524337 | A1 | * | 9/1995 | B63C 7/20 |

OTHER PUBLICATIONS

International Search Report dated Feb. 17, 2012 of PCT/KR2011/004690 which is the parent application—4 pages.

International Search Report dated Feb. 17, 2012 of related PCT Application No. PCT/KR2011/004691—4 pages.

Office Action dated Feb. 18, 2014 of related Japanese Patent Application 2013-536486—2 pages.

* cited by examiner

Prior Art

DRILLING SHIP FOR POLAR REGION

CROSS-REFERENCE(S) TO RELATED APPLICATION

This application claims priority of Korean Patent Application No. 10-2010-0109530, filed on Nov. 5, 2010, in the Korean Intellectual Property Office, which is hereby incorporated by reference in its entirety.

BACKGROUND OF THE INVENTION

1. Field of the Invention

The present invention relates to an arctic drill ship, and more particularly, to an arctic drill ship in which a weather tight structure minimizing the influence of outside air on a drilling operation in polar regions can be installed economically and easily and a structure causing a disturbance in the drilling work area is minimized.

2. Description of the Related Art

Generally, a drill ship is a generic term for ships that explore and drill marine resources such as oil or gas, and examples of the drill ship include a fixed type platform, a semi-submersible drill ship, and so on.

With the rapid development of technologies necessary to explore and drill oil and natural gas buried under the seabed, the working area of the drill ship has expanded from a shallow area such as a continental shelf having a depth of about 200 m to an area having a poor environment such as a deep sea or a polar region having a depth of 2,000 m or more.

FIG. 1 is a cross-sectional view illustrating a conventional drill ship. In the conventional drill ship 10, as illustrated in FIG. 1, a drill floor 12 is provided on a deck 12 of a hull 11, and a derrick 13 is fixed to the drill floor 12. The derrick 13 is a large complicated structure provided with beams and a variety of drilling equipments. A large moonpool 14 such a drill well is formed in the hull 11 in order for installation of drilling equipments.

In the case where such a conventional drill ship is operated in a polar region, the drilling equipment and the workspace are exposed to a low-temperature outside air and thus it is difficult to perform the drilling operation. Therefore, it is necessary to enclose the drilling equipment and the workspace such that they are not exposed to outside air.

However, in the case of the drill ship, main drilling equipments are extensively disposed in a rig floor, a hurricane deck, and a moonpool zone, it is difficult to enclose the drilling work area through a hull structure of a conventional drill ship. It is uneconomical and there is an unavoidable problem in that structures causing interference dangers during operations are disposed, when considering drilling operation characteristics.

SUMMARY OF THE INVENTION

An aspect of the present invention is directed to an arctic drill ship in which a weather tight structure as a concept of a single compartment is made from a side strake or a position near to the side strake to an upper portion of a hurricane deck, thereby minimizing the influence of outside air on a drilling operation in polar regions and minimizing a structure that disturbs a drilling work area.

According to an embodiment of the present invention, an arctic drill ship includes: a weather tight structure protecting a drill floor from outside air; and a side strake supporting the weather tight structure around a drilling work area.

The side strake may include an extension part extending upward from a hurricane deck around the drilling work area, and the weather tight structure is supported on the extension part.

The arctic drill ship may include a reinforcement part having a grillage girder structure on the side strake.

Both sides of the drill floor may extend up to a position corresponding to a width of a hull.

The weather tight structure may include a blocking part enclosing a derrick which protrudes upward.

DETAILED DESCRIPTION OF EXEMPLARY EMBODIMENTS

Exemplary embodiments of the present invention will be described below in detail with reference to the accompanying drawings. The present invention may, however, be embodied in different forms and should not be construed as limited to the embodiments set forth herein.

Figure 1:
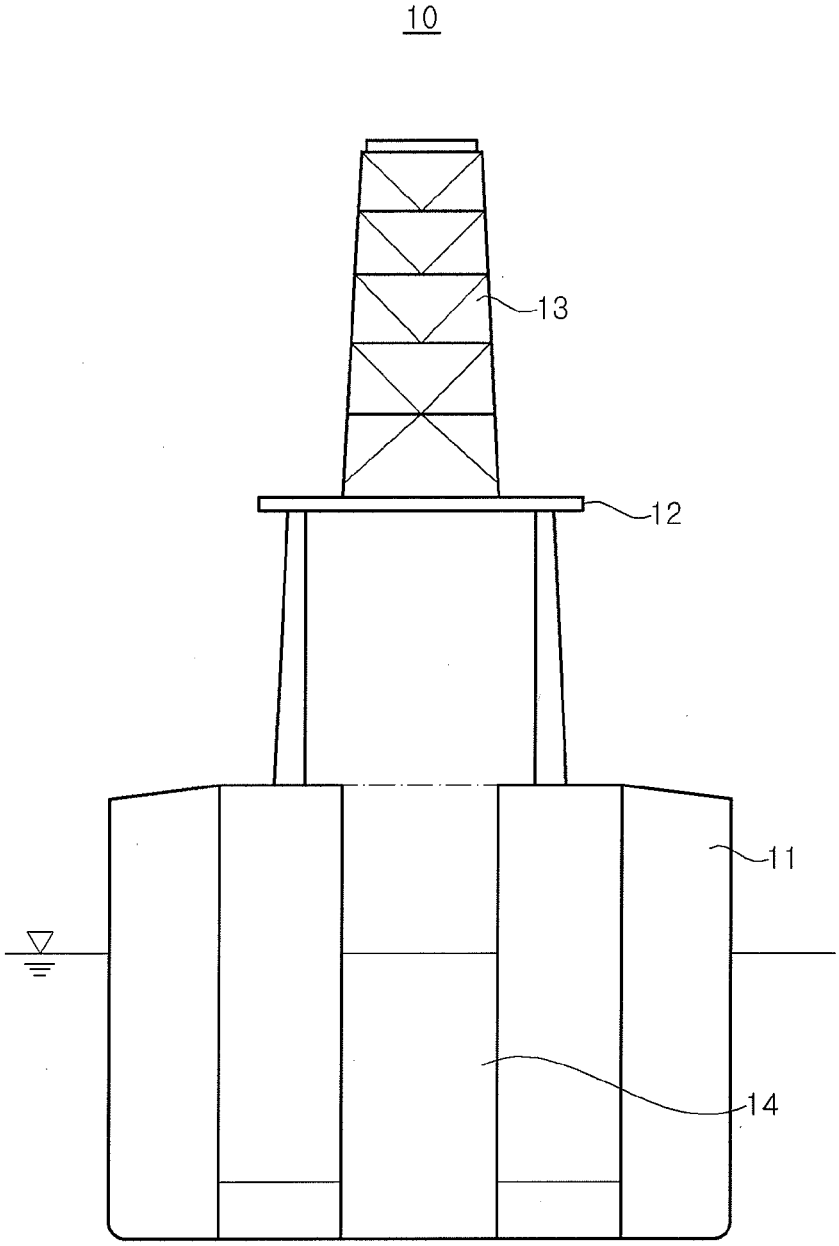
FIG. 1 is a cross-sectional view illustrating a conventional arctic drill ship.
Figure 2:
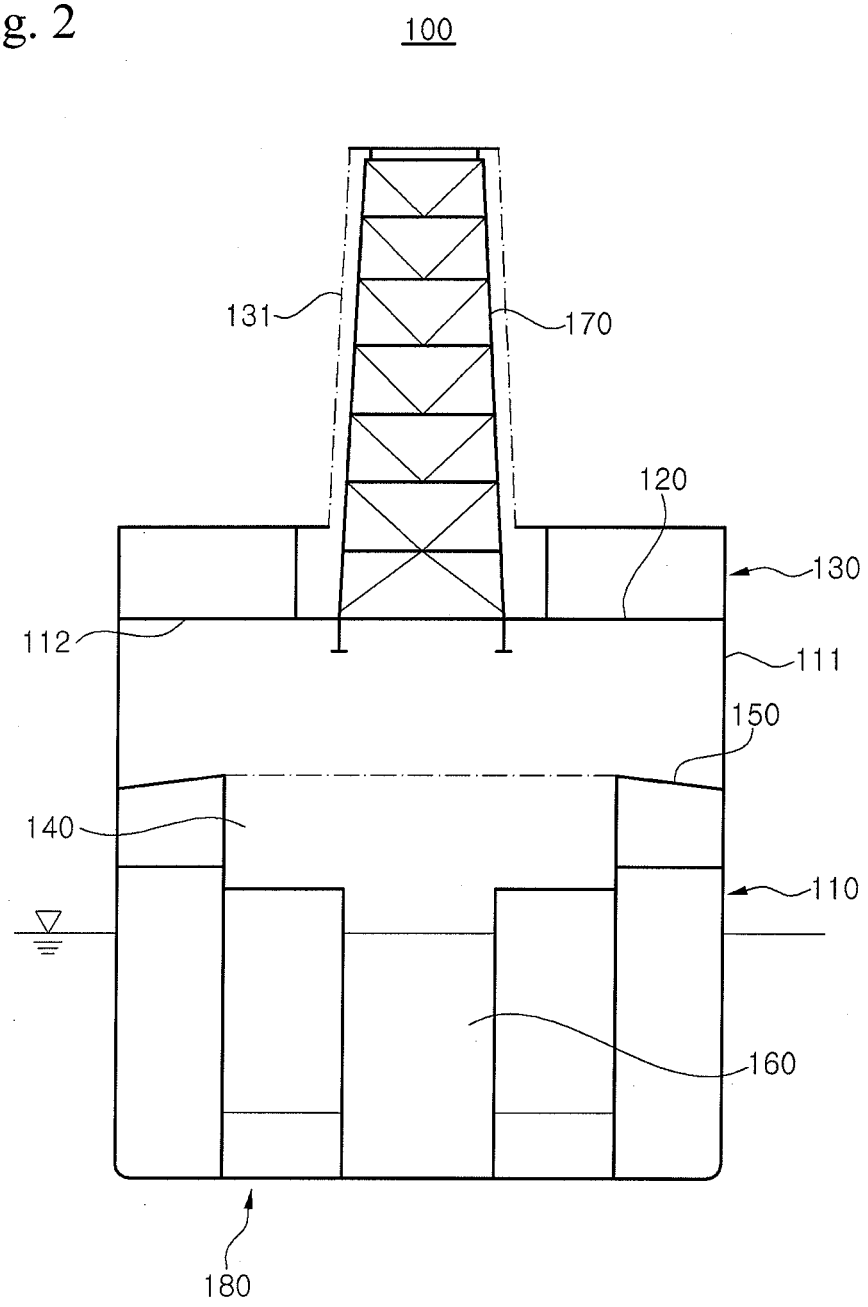
FIG. 2 is a cross-sectional view illustrating an arctic drill ship according to the present invention.

FIG. 2 is a cross-sectional view illustrating an arctic drill ship according to the present invention.

As illustrated in FIG. 2, the arctic drill ship 100 according to the present invention is a drill ship that can be operated in polar regions. A side strake 110 supports a weather tight structure 130 which protects a drill floor 120 from outside air.

The side strake 110 supports the weather tight structure 130 around a drilling work area 140. As one example, an extension part 111 is formed to extend upward from a hurricane deck 150 around the drilling work area 140. The weather tight structure 130 is supported on the extension part 111. Accordingly, the extension part 111 of the side strake 110 and the weather tight structure 130 block a zone ranging from a moonpool 160 to the drill floor 120 from outside air, and the weather tight structure 130 is easily installed.

The side strake 110 may include a reinforcement part 112 having a grillage girder system on an upper portion, for example, an upper portion of the extension part 111 in order to stably support the weather tight structure 130. The reinforcement member 112 may be manufactured using a longitudinal end structure of the moonpool 160 and the weather tight structure. The reinforcement member 112 reinforces a drilling load applied to the weather tight structure 130.

The weather tight structure 130 is manufactured to enclose the drill floor 120 in order to protect the drill floor 120 from outside air and is supported by the side strake 110. To this end, the weather tight structure 130 may be fixed to the side strake 110 by a welding, a fixing member, or other methods. A derrick 170 is fixed to an upper portion of the drill floor 120. Both sides of the drill floor 120 may extend up to a position corresponding to a width of a hull 180 in order to ensure the drilling work area 140, minimize a structure causing a disturbance in the drilling work area 140, and stably support the weather tight structure 130. Hence, the weather tight structure 130 also has a width corresponding to the width of the hull 180.

The weather tight structure 130 may include a blocking section 131 enclosing the derrick 170 that protrudes upward. Therefore, it is possible to prevent outside air from being entered or exited through the derrick 170.

The operation of the arctic drill ship according to the present invention will be described below.

According to the present invention, the weather tight structure 130 surrounding the drill floor 120 is supported by the structure of the side strake 110. Therefore, a monocoque type hull 180 capable of effectively supporting the hull longitudinal strength and the weather tight structure 130 is proposed. All zones ranging from the moonpool 160 to the drill floor 120 are protected from outside air by the extension part 111 of the side strake 110 and the weather tight structure 130. The term "monocoque type" means that the hull structure is formed only by an external structure. According to the present invention, the hull longitudinal strength and the upper structure are efficiently supported only by the side strake 110 of the monocoque type hull in order to ensure safety in the drilling workspace.

In addition, since the weather tight structure 130 is supported by the side strake 110, it is possible to reduce time and cost necessary to install the weather tight structure 130, and the reinforcement structure of the weather tight structure 130 can be made not to disturb the drilling operation. In addition, the operational load and environmental load that may be generated during the drilling operation can be tolerated by the reinforcement member 112 of the side strake 110. Therefore, it is unnecessary to install a separate structural reinforcement member for the drilling workspace in the polar regions. Moreover, the drilling workspace in the polar regions can be effectively ensured and the spatial limitation of the upper zone of the moonpool 160 can be prevented.

According to the present invention, it is possible to economically and easily manufacture the weather tight structure which minimizes the influence of outside air on the drilling operation in the polar regions, and it is possible to efficiently support the hull longitudinal strength and the weather tight structure with the use of the side strake structure solely. Therefore, a structure which may cause a disturbance in the drilling work area is minimized, and it is unnecessary to install a separate structural reinforcement member for a drilling workspace in the polar regions. In addition, the drilling workspace in the polar regions can be effectively ensured, and a spatial limitation in an upper portion of a moonpool can be solved.

While the embodiments of the present invention have been described with reference to the specific embodiments, it will be apparent to those skilled in the art that various changes and modifications may be made without departing from the spirit and scope of the invention as defined in the following claims.

What is claimed is:

1. An arctic drill ship, comprising:

a hull comprising a first side strake and a second side strake opposing the first side strake, the hull having a hull width defined between the first and second side strakes in a cross-section of the ship crossing the first and second side strakes;

a first extension sidewall extending upwardly from the first side strake such that the first extension sidewall's bottom is placed directly above the first side strake;

a second extension sidewall extending upwardly from the second side strake such that the second extension sidewall's bottom is placed directly above the second side strake and such that a gap between the first and second extension sidewalls in the cross-section corresponds to the hull width defined between the first and second side strakes;

a drill floor installed over the hull and extending laterally between the first and second extension sidewalls such that in the cross-section a first end of the drill floor contacts an upper portion of the first extension sidewall and a second end of the drill floor contacts an upper portion of the second extension sidewall;

a derrick fixed to and supported by the drill floor; and a weather tight structure covering the drill floor for protecting from outside air and extending laterally between the first and second extension sidewalls in the cross section, wherein the weather tight structure is supported by the first and second side strakes via the first and second extension sidewalls such that weight of the weather tight structure applied onto the first extension sidewall is directly supported by the first side strake as the first extension sidewall's bottom is placed directly above the first side strake and further such that weight of the weather tight structure applied onto the second extension sidewall is directly supported by the second side strake as the second extension sidewall's bottom is placed directly above the second side strake.

2. The arctic drill ship according to claim 1, further comprising a hurricane deck under the drill floor, wherein the first and second side extensions extend upwardly beyond a level of the hurricane deck.

3. The arctic drill ship according to claim 1, wherein the weather tight structure comprises a blocking part enclosing the derrick.

4. The arctic drill ship according to claim 2, wherein the weather tight structure comprises a blocking part enclosing the derrick which protrudes upward.

5. The arctic drill ship according to claim 1, wherein the weather tight structure laterally extends over the drill floor in which outermost edges of the weather tight structure are placed over the first and second extension sidewalls such that the weather tight structure is supported by the first and second side strakes via the first and second extension sidewalls.

6. The arctic drill ship according to claim 5, wherein a hurricane deck is installed on an inner side of one of the first and second extension sidewalls.

7. The arctic drill ship according to claim 1, wherein the weather tight structure comprises sidewalls that are aligned with and supported by the first and second extension sidewalls such that the weather tight structure is supported by the first and second side strakes via the first and second extension sidewalls.

8. The arctic drill ship according to claim 1, wherein in the cross-section the outermost edges of the drill floor are aligned with the first and second extension sidewalls such that the outermost edges are supported by the first and second extension sidewalls.

9. The arctic drill ship according to claim 8, wherein the outermost edges are supported by the first and second side strakes via the first and second extension sidewalls.

10. The arctic drill ship according to claim 8, wherein the weather tight structure comprises sidewalls that are aligned with and supported by the first and second extension sidewalls.

11. The arctic drill ship according to claim 8, wherein the hurricane deck is installed on an inner side of one of the first and second extension sidewalls.

12. The arctic drill ship according to claim 1, further comprising a drilling work area enclosed by the drill floor and the first and second extension sidewalls.

13. An arctic drill ship, comprising:

a hull comprising a first side strake and a second side strake opposing the first side strake;

a first upward extension extending upwardly from the first side strake such that the first upward extension and the first side strake together form a first sidewall of the ship in a cross-section of the drill ship crossing the first and second side strakes;

a second upward extension extending upwardly from the second side strake such that the second upward extension and the second side strake together form a second sidewall of the ship in the cross-section of the drill ship crossing the first and second side strakes;

a drill floor installed over the hull and extending laterally such that a first outermost edge of the drill floor contacts an upper portion of the first upward extension and a second outermost edge of the drill floor contacts an upper portion of the second upward extension;

a derrick fixed to and supported by the drill floor; and a weather tight structure covering the drill floor for protecting from outside air, the weather tight structure supported by the first and second side strakes via the first and second upward extensions.

14. The artic drill ship of claim 13, wherein the weather tight structure is supported by the first and second side strakes via the first and second upward extensions such that weight of the weather tight structure applied onto the first upward extension is directly supported by the first side strake as the first upward extension's bottom is placed directly above the first side strake and further such that weight of the weather tight structure applied onto the second upward extension is directly supported by the second side strake as the second upward extension's bottom is placed directly above the second side strake.

* * * * *